US007118465B2

(12) United States Patent
Kim

(10) Patent No.: US 7,118,465 B2
(45) Date of Patent: Oct. 10, 2006

(54) GRINDING ASSEMBLY OF SEMICONDUCTOR WAFER BACK-GRINDING APPARATUS AND METHOD OF FASTENING A GRINDING PLATE TO A GRINDING MOUNT OF THE SAME

(75) Inventor: Jong-su Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/176,229

(22) Filed: Jul. 8, 2005

(65) Prior Publication Data

US 2006/0121840 A1 Jun. 8, 2006

(30) Foreign Application Priority Data

Dec. 3, 2004 (KR) ..... 10-2004-0101142

(51) Int. Cl.
*B24B 7/22* (2006.01)

(52) U.S. Cl. ..... 451/290; 451/342; 451/509

(58) Field of Classification Search ..... 451/290, 451/269, 285, 287, 509, 342
See application file for complete search history.

(56) References Cited

U.S. PATENT DOCUMENTS 2,747,343 A * 5/1956 Gellert ..... 451/342
2,781,618 A * 2/1957 Larson ..... 451/509
4,322,920 A * 4/1982 Wells ..... 451/342
4,663,890 A * 5/1987 Brandt ..... 451/41
5,584,750 A * 12/1996 Ishida et al. ..... 451/288
5,704,827 A * 1/1998 Nishi et al. ..... 451/285
5,927,264 A * 7/1999 Worley ..... 125/36
5,931,724 A * 8/1999 Perlov et al. ..... 451/285

FOREIGN PATENT DOCUMENTS

| | | |
|---|---|---|
| JP | 09-029627 | 2/1997 |
| KR | 0127523 | 7/1998 |
| KR | 20-0229678 | 4/2001 |

* cited by examiner

*Primary Examiner*—Robert A. Rose
(74) *Attorney, Agent, or Firm*—Volentine Francos & Whitt, PLLC

(57) ABSTRACT

A semiconductor manufacturing apparatus includes a wafer support having a grinding base on which a wafer is disposed, and a grinding assembly disposed above the grinding base. The grinding assembly includes a grinding plate having grinding projections at the bottom thereof and at least two fixing pins protruding at a the top thereof, and a grinding mount to which the grinding plate to which the grinding plate can be initially coupled and then secured to quickly. The grinding mount has first fixing grooves in a bottom surface thereof and in which the respective fixing pins are inserted and held. A vacuum system and/or mechanical fasteners are used to then secure the grinding plate to the grinding mount.

18 Claims, 7 Drawing Sheets

GRINDING ASSEMBLY OF SEMICONDUCTOR WAFER BACK-GRINDING APPARATUS AND METHOD OF FASTENING A GRINDING PLATE TO A GRINDING MOUNT OF THE SAME

BACKGROUND OF THE INVENTION

1. Field of the Invention

The present invention relates to a process of grinding the back of a wafer in the manufacturing of a semiconductor device. More particularly, the present invention relates to grinding apparatus for grinding the back of a semiconductor wafer and to a method of fixing a grinding plate in an assembly of the grinding apparatus.

2. Description of the Related Art

A semiconductor wafer is subjected to a back grinding process after a device is formed on the semiconductor wafer and before the device is packaged. The back grinding process includes attaching a tape to and over the front of the wafer, subsequently grinding the back of the wafer, and then removing the tape from the front of the wafer. This so-called back grinding process is performed to reduce the thickness of the wafer enough so that the resulting structure can be assembled in a package.

The apparatus for carrying out the back grinding process includes a support for stably supporting a semiconductor wafer, and a grinding assembly disposed above the support and capable of grinding the back side of the semiconductor wafer. The grinding assembly includes a grinding mount, a grinding plate attached to a lower portion of the grinding mount for grinding the back side of the semiconductor wafer, and a driving motor connected to the grinding mount via a rotary shaft for rotating the grinding plate.

FIG. 1A and FIG. 1B illustrate a conventional grinding assembly 30 of semiconductor wafer back-grinding apparatus. Referring to these figures, a grinding mount 20 is provided with a plurality of bolt holes 24 into which bolts 22 are inserted. A grinding plate 10 has threaded holes 12 in the top thereof at locations corresponding to the locations of the bolt holes 24. The bolts 22 extend through the bolt holes 24 and are threaded to the grinding plate 10 within the corresponding threaded holes 12, respectively. A driving motor (not shown) is connected to the grinding mount 20 by a rotary shaft 26 to rotate the grinding plate 10. Reference numeral 14 designates grinding projections which grind the back side of the semiconductor wafer.

In order to attach the grinding plate 10 to the grinding mount 20, the grinding plate 10 must first be aligned with the bottom of the grinding mount 20. Then the grinding plate 10 is fastened to the grinding mount 20 with the bolts 22. In this case, however, the forces exerted by the bolts 22 on the grinding plate may differ, thereby making it difficult to properly level the grinding plate 10, i.e., thereby making it difficult to ensure that the tips of the grinding projections 14 all lie in a horizontal plane. That is, it is time-consuming to accurately position the grinding plate 10 relative to a wafer when fastening the grinding plate 10 to the grinding mount 20.

SUMMARY OF THE INVENTION

An object of the present invention is to provide a grinding apparatus having a grinding assembly in which a grinding plate can be quickly mounted in a precise position to a grinding mount.

Likewise, an object of the present invention is to provide a method of fastening a grinding plate to a grinding mount of grinding apparatus, which can be carried out in a short amount of time and yet wherein the grinding plate is positioned precisely in the grinding apparatus.

According to one aspect of the present invention, there is provided a grinding assembly including a grinding plate having grinding projections at the bottom thereof and at least two fixing pins protruding at the top thereof, and a grinding mount having at least two first fixing grooves in a bottom surface thereof, at least two second fixing grooves in the bottom surface, and first guide grooves extending in the bottom surface along respective arcs of a circle. Each of the first guide grooves connects a respective one of the first fixing grooves to a respective one of the second fixing grooves.

Each of the fixing pins may have a spherical coupling projection at the top thereof. In addition, annular rubber packings are fixed on walls of the grinding mount which define the sides of the second fixing grooves, respectively. Each of the packings has an inner diameter smaller than the diameter of the second fixing groove and smaller than the diameter of the coupling projection received in the second fixing groove. Thus, the packings can hold the fixing pins within the second fixing grooves.

The fixing pins lie along a circle having a radius equal to that of the circle along which the first guide grooves extend, and the fixing pins are spaced from each other along that circle by equal distances. The second fixing grooves may be deeper than the first fixing grooves, and the fixing projections may have a height substantially equal to the depth of the second fixing grooves. Accordingly, the grinding plate may be coupled to the grinding mount by placing the fixing projections in the first fixing grooves, respectively, rotating the grinding plate relative to the grinding mount to slide the fixing pins along guide the grooves until the fixing pins enter the second fixing grooves, and then pressing the grinding plate towards the grinding mount to force the coupling projections of the fixing pins through the annular packings and into the bottoms of the second fixing grooves.

According to another aspect of the present invention, there is provided a grinding assembly including a grinding plate having grinding projections at the bottom thereof and at least two fixing pins protruding at the top thereof, a grinding mount having fixing grooves in the bottom surface and in which the fixing pins are received, respectively, and holding means for holding the fixing pins within the fixing grooves such that the grinding plate is coupled to the grinding plate, and fastening means for detachably securing the grinding plate to the grounding mount.

The holding means of the grinding mount may comprise the annular rubber packings fixed on the walls of the grinding mount that define the sides of the second fixing grooves, respectively.

The grinding mount may also have a first vacuum passage connected to the fixing grooves and/or a plurality of second vacuum passages spaced along a circle and open at the bottom surface thereof. In this case, the fastening means is a vacuum pump connected to the vacuum passage or passages.

Alternatively or additionally, the fastening means may comprise at least two fastening units mounted on the sidewall of the grinding mount. Each of the fastening units includes a mechanical fastener that is capable of detachably securing the grinding plate to the grinding mount.

According to still another aspect of the present invention, there is provided a method of fastening a grinding plate to a grinding mount, wherein the grinding plate is initially coupled to the grinding mount, and then is detachably secured to the grinding mount using a fastening system. The grinding plate is initially coupled to the grinding mount by inserting fixing pins of the grinding plate into fixing grooves of the grinding mount to bring a top surface of the grinding plate flush against the bottom surface of the grinding mount, and holding the fixing pins within the fixing grooves. In this respect, the fixing pins are urged to the bottom of the fixing grooves, respectively, through rubber packings each having an inner diameter smaller than that of the outer diameter of coupling projections of the fixing pins.

The grinding plate may be secured to the grinding mount by forming a vacuum in the fixing grooves to thereby exert vacuum pressure on the fixing pins and/or by forming a vacuum at an interface between the bottom surface of the grinding mount and the top surface of the grinding plate. The grinding plate may also be secured to the grinding mount with mechanically fasteners.

BRIEF DESCRIPTION OF THE DRAWINGS

The above and other objects, features and advantages of the present invention will become more apparent from the following detailed description of the preferred embodiments thereof made with reference to the attached drawings in which.

DETAILED DESCRIPTION OF THE PREFERRED EMBODIMENTS

The present invention will now be described more fully with reference to FIGS. 2–4F.

Figure 1A:
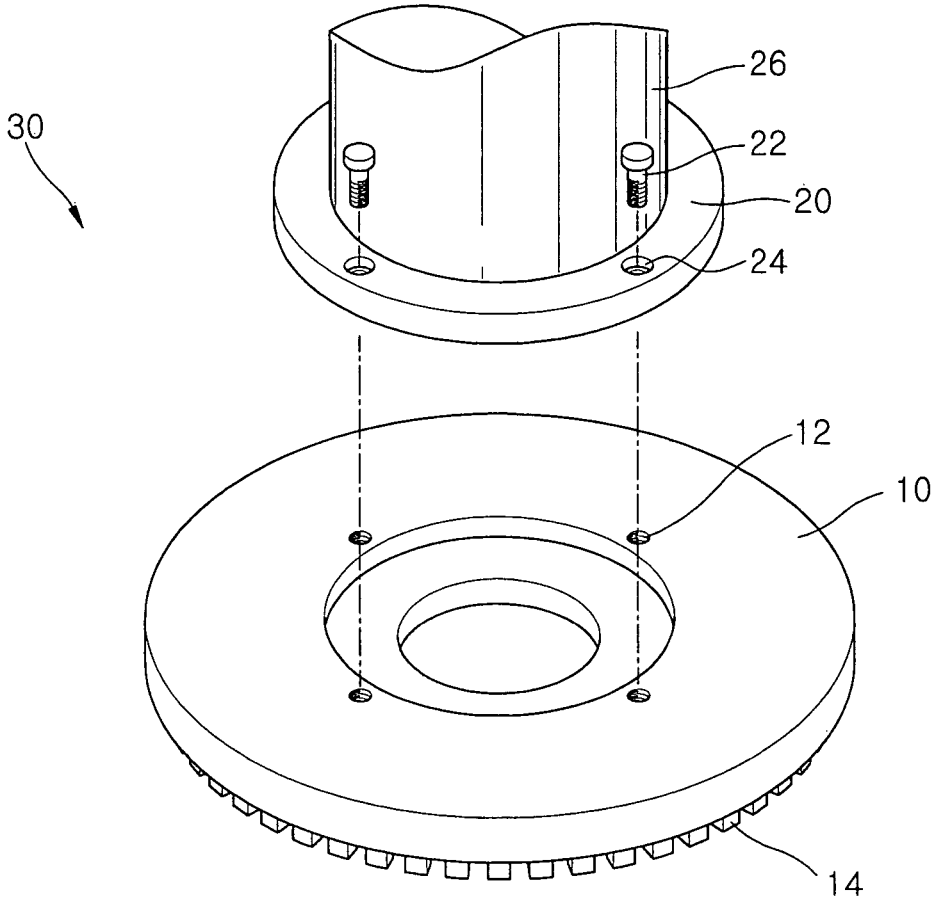
FIG. 1A (PRIOR ART)
FIG. 1A is a perspective view of a prior art grinding assembly of semiconductor wafer back-grinding apparatus.
Figure 1B:
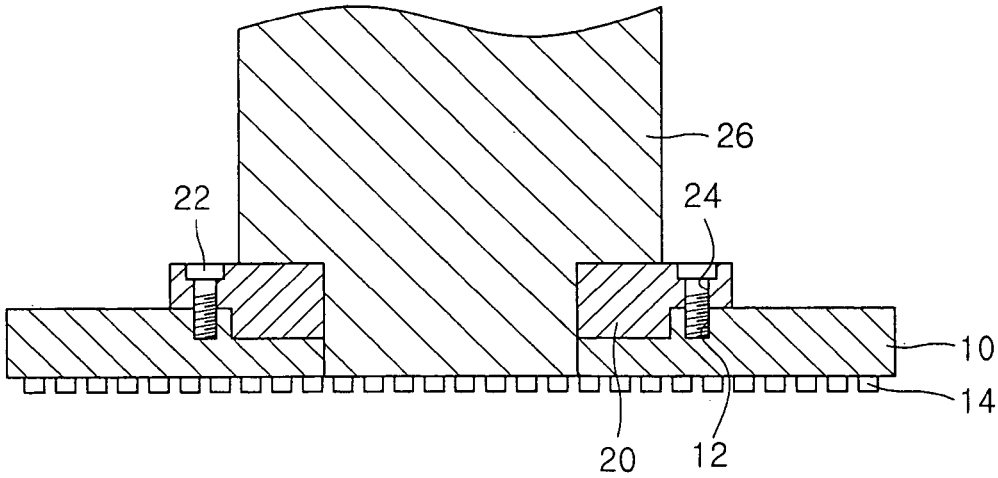
FIG. 1B (PRIOR ART)
FIG. 1B is a sectional view of the prior art grinding assembly.
Figure 2:
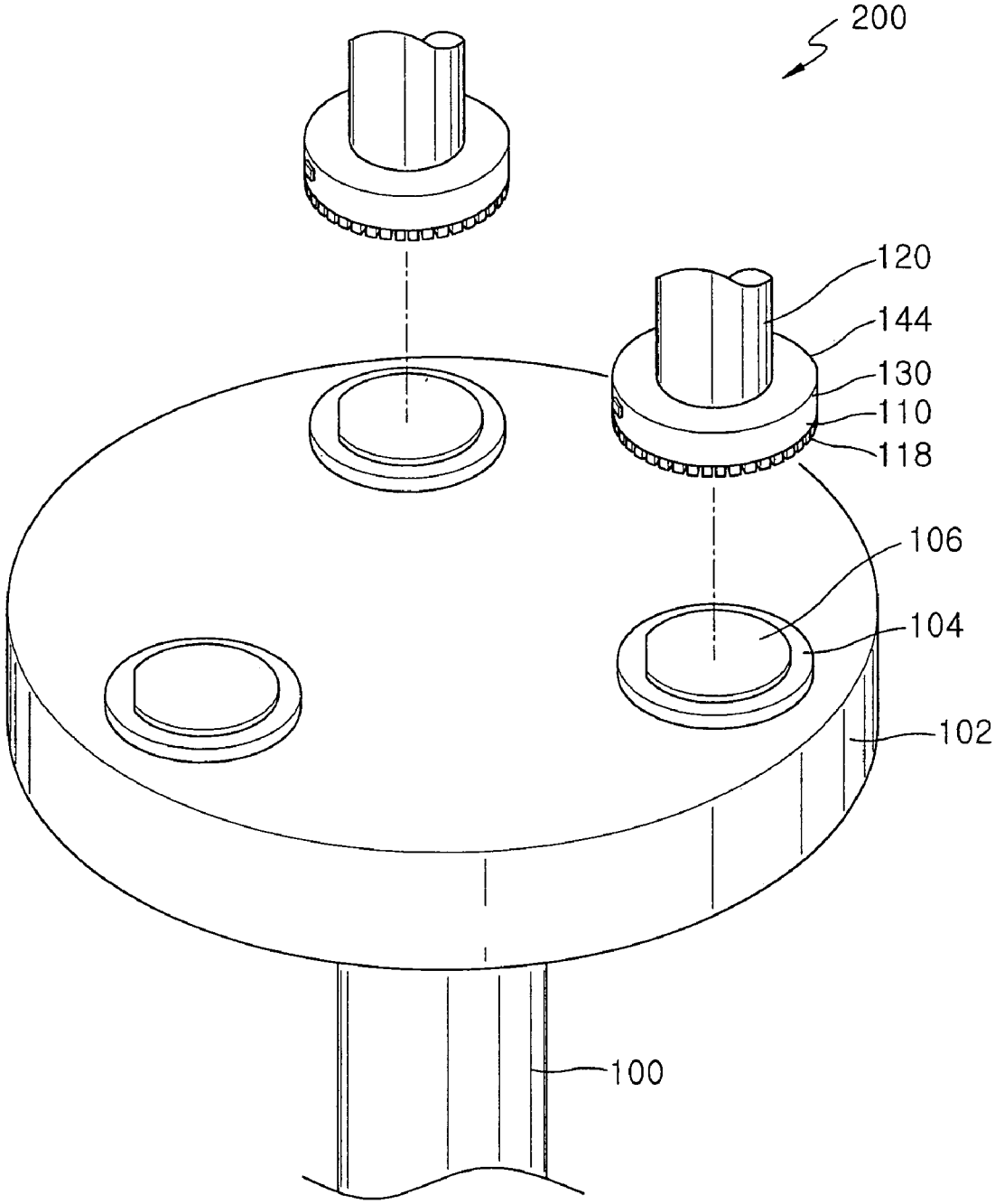
FIG. 2 is a perspective view of a semiconductor wafer back-grinding apparatus according to the present invention.

Referring first to FIG. 2, the semiconductor wafer back-grinding apparatus includes a wafer support 102, a plurality of grinding bases 104 disposed on the wafer support 102 for supporting semiconductor wafers 106, respectively, and a driving shaft 100 connected to the wafer support 102 for rotating the wafer support 102. The apparatus further includes grinding assemblies 200 disposed above the wafer support 102. Each grinding assembly 200 includes a grinding plate 110, a grinding mount 130 to which the grinding plate 110 is attached, and a driving motor (not shown) connected to the grinding mount 130 by a rotational shaft 120 for rotating the grinding plate 110. The grinding plate 110 includes a plate body and a plurality of grinding projections 118 at the periphery of the bottom of the plate body. The grinding projections 118 may contain diamond particles for grinding the back side of a wafer 106. Also, the grinding mounts 130 are disposed above and spaced a predetermined distance from the grinding bases 104 and hence, from the wafers 106 supported on the grinding bases 104.

Figure 3:
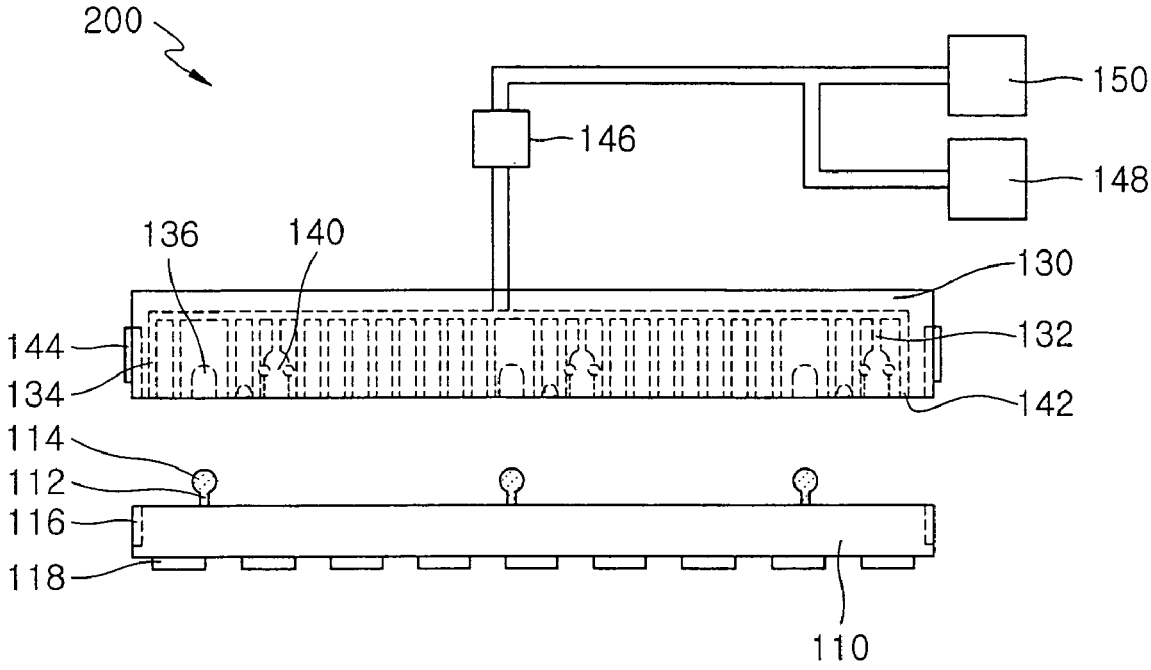
FIG. 3 is a side view of an embodiment of a grinding assembly of semiconductor wafer back-grinding apparatus according to the present invention, with internal non-visible passages and grooves of the grinding assembly depicted by dashed lines in FIG. 3.
Figure 4A:
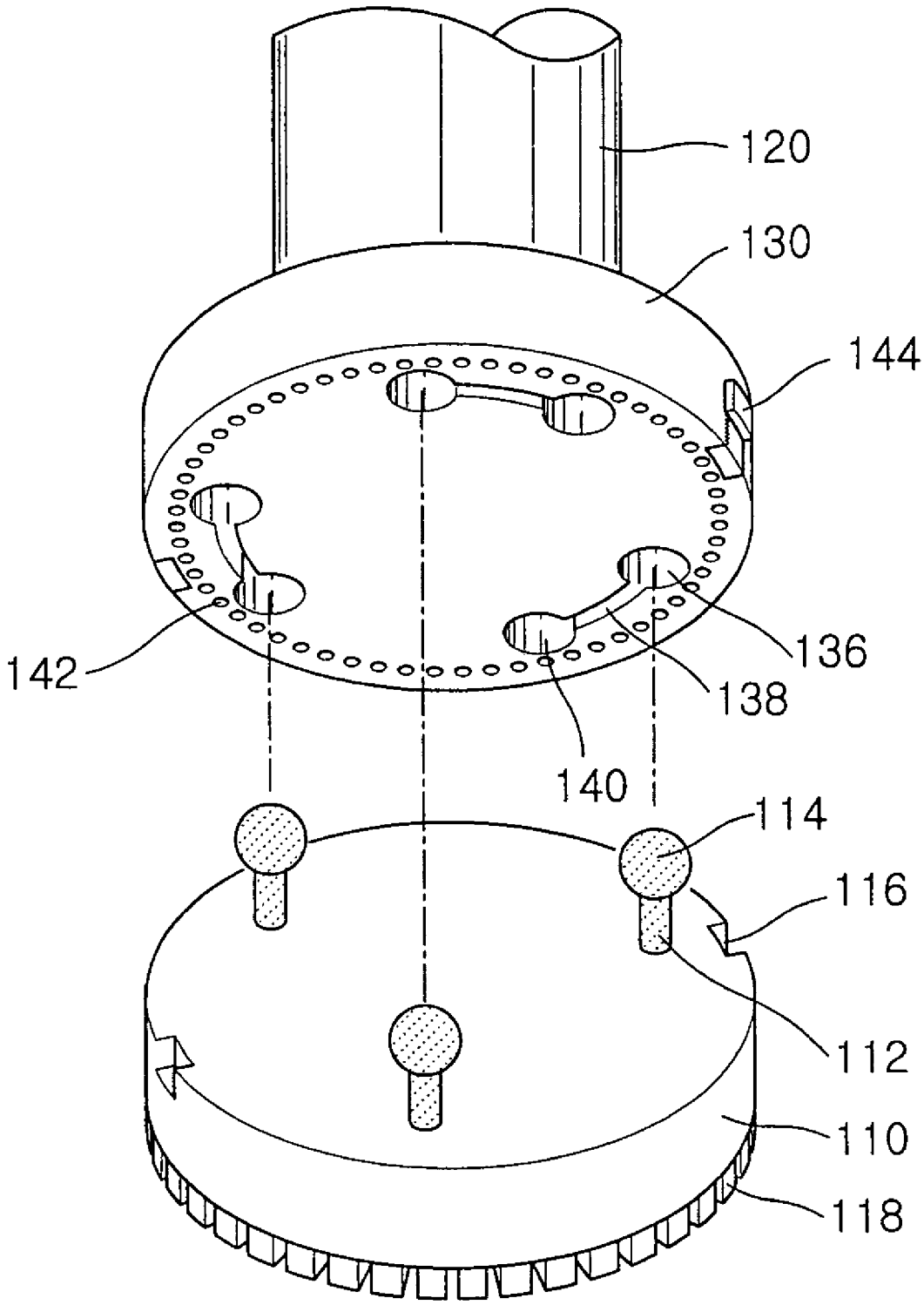
FIG. 4A is a perspective of the grinding assembly according to the present invention.

Referring now to FIGS. 3 and 4A, each grinding plate 110 also comprises at least two fixing pins 112 projecting upwardly from a flat top surface of the plate body for securely fixing the grinding plate 110 to the grinding mount 130. To this end, each fixing pin 112 comprises a pin body and a coupling projection 114 at the top of the pin body. The coupling projections 114 may be spherical, cylindrical, or otherwise polyhedral. Also, the fixing pins 112 all lie along a circle whose center coincides with that of the top surface of the grinding plate and are spaced from each by equal distances along that circle.

The grinding mount 130 has at least two first fixing grooves 136 in an otherwise flat bottom surface thereof. The first fixing grooves 136 are configured to receive the respective fixing pins 112. In particular, the bottom of each first fixing groove 136 has a shape corresponding to that of a coupling projection 114. In this embodiment, the walls of the grinding mount 130 defining the bottom of the first fixing grooves 136, and the coupling projections 114 have complementary spherical surfaces. Furthermore, the walls of the grinding mount 130 defining the sides and bottom of each of the first fixing grooves 136 may be formed of rubber to prevent the coupling projections 114 from being damaged and to form a seal.

The grinding mount 130 also has at least two second fixing grooves 140 and first guide grooves 138 in the bottom thereof. The first guide grooves 138 extend along arcs of a circle whose radius is the same as that of the circle along which the fixing pins are spaced from one another. Also, the first guide grooves 138 connect the second fixing grooves 140 to the first fixing grooves 136, respectively. Each second fixing groove 140 is deeper than the first fixing groove 136 that is connected thereto. The height of the fixing pins 114 is substantially the same as the depth of the second fixing grooves The bottom of each of the second fixing grooves 140 is connected to a first vacuum passage 132 so that the second fixing groove 140 can be evacuated. A wall defining the bottom of each second fixing groove 140 has a shape corresponding to that of a coupling projection 114. Also, the walls of the grinding mount 130 which define the sides and bottom of each of the second fixing grooves 140 may be formed of rubber to prevent the coupling projections 114 from being damaged and to facilitate the forming of a vacuum seal.

Figure 4B:
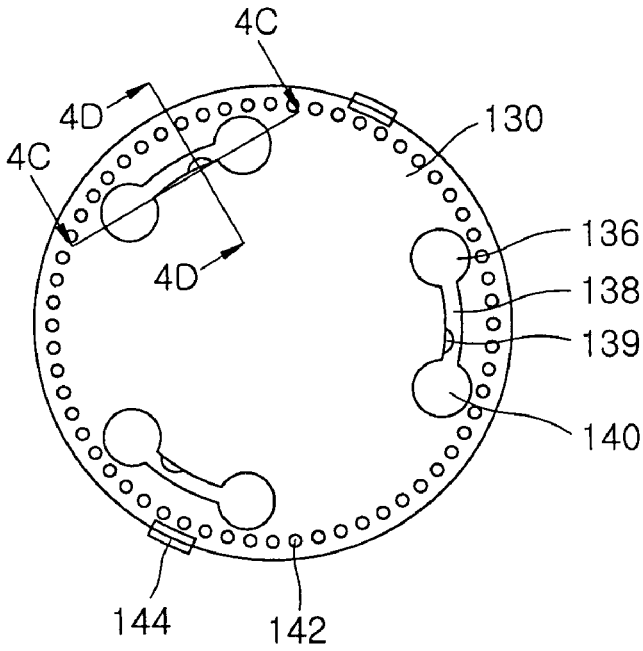
FIG. 4B is a bottom view of a grinding mount of the grinding assembly according to the present invention.
Figure 4C:
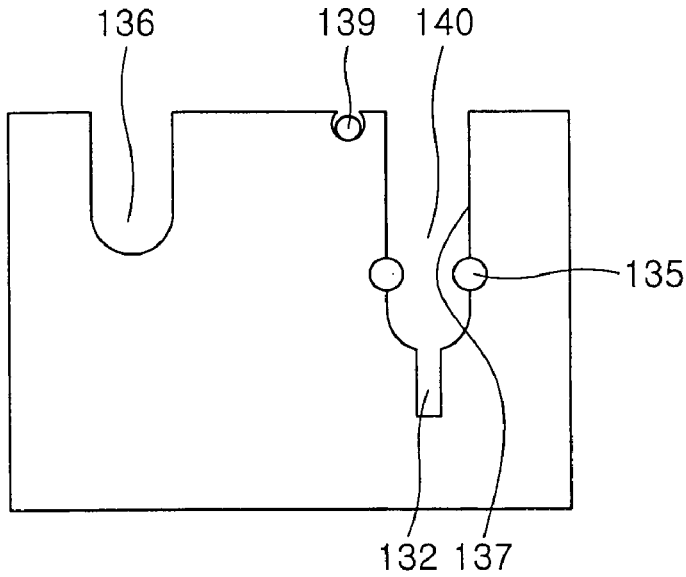
FIG. 4C is a sectional view of the grinding mount taken along line 4C—4C of FIG. 4B.

Referring to FIG. 4C, a respective annular rubber packing 135 is fixed to the wall 137 that defines the sides of each second fixing groove 140. The rubber packing 135 has an inner diameter smaller than the diameter of the second fixing groove 140, so as to protrude into the second fixing groove 140, and smaller than the diameter of the coupling projection 114. Accordingly, the rubber packing 135 will tightly contact the coupling projection 114 of the fixing pin 112, will hold the fixing pin 112 in the second fixing groove 140 via the coupling projection 114, and will establish a seal therewith as will be described in more detail later on.

The grinding mount 130 may also have second vacuum passages 134 spaced from one another along a circle whose center coincides with that of the bottom surface of the grinding mount 130. The second vacuum passages 134 terminate at vacuum holes 142 open at the bottom surface of the grinding mount 130. A vacuum pump 150 is connected to the first and second vacuum passages 132 and 134 for creating a vacuum therein. On the other hand, an air injector 148, such as a compressor, is also connected to the first and second vacuum passages 132 and 134 so as to inject air into the first and second vacuum passages 132 and 134 and thereby relieve the vacuum pressure when desired. The pressure of the first and second vacuum passages 132 and 134 is measured by a pressure sensor 146 connected to the first and second vacuum passages 132 and 134.

Figure 4D:
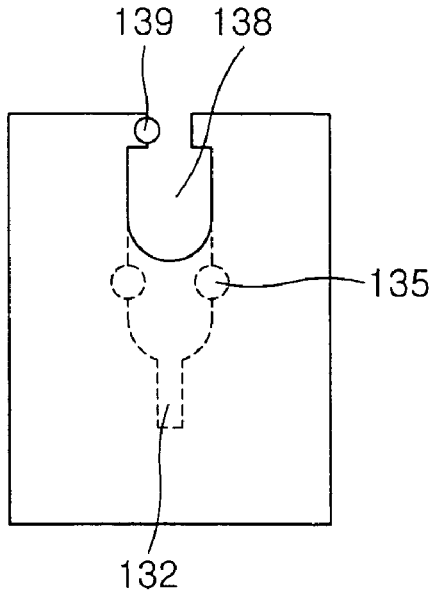
FIG. 4D is a sectional view of the grinding mount taken along line 4D—4D of FIG. 4B.

Referring now to FIGS. 4B and 4D, a respective fixing ball 139 may project into each of the first guides 138 at sides thereof adjacent the second fixing grooves 140. The fixing balls 139 function to accurately set the fixing pins 112 in the fixing grooves 140 and to prevent the fixing pins 112 from sliding out of the second fixing grooves 140 even when the vacuum produced in the fixing grooves 140 is relieved.

Figure 4E:
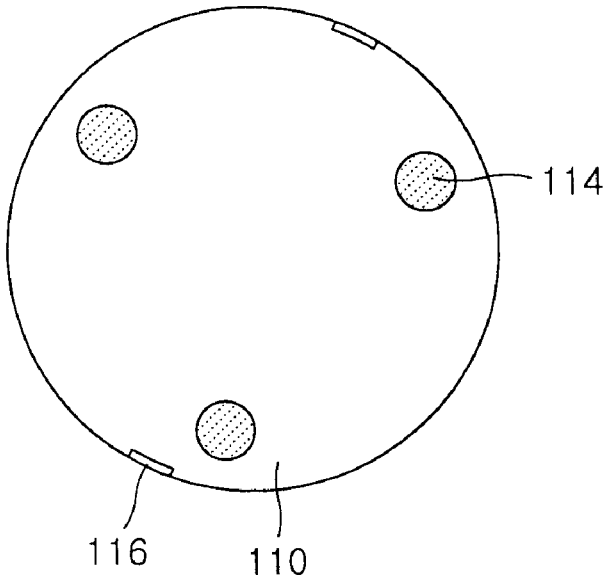
FIG. 4E is a plane view of a grinding plate of the grinding assembly according to the present invention.
Figure 4F:
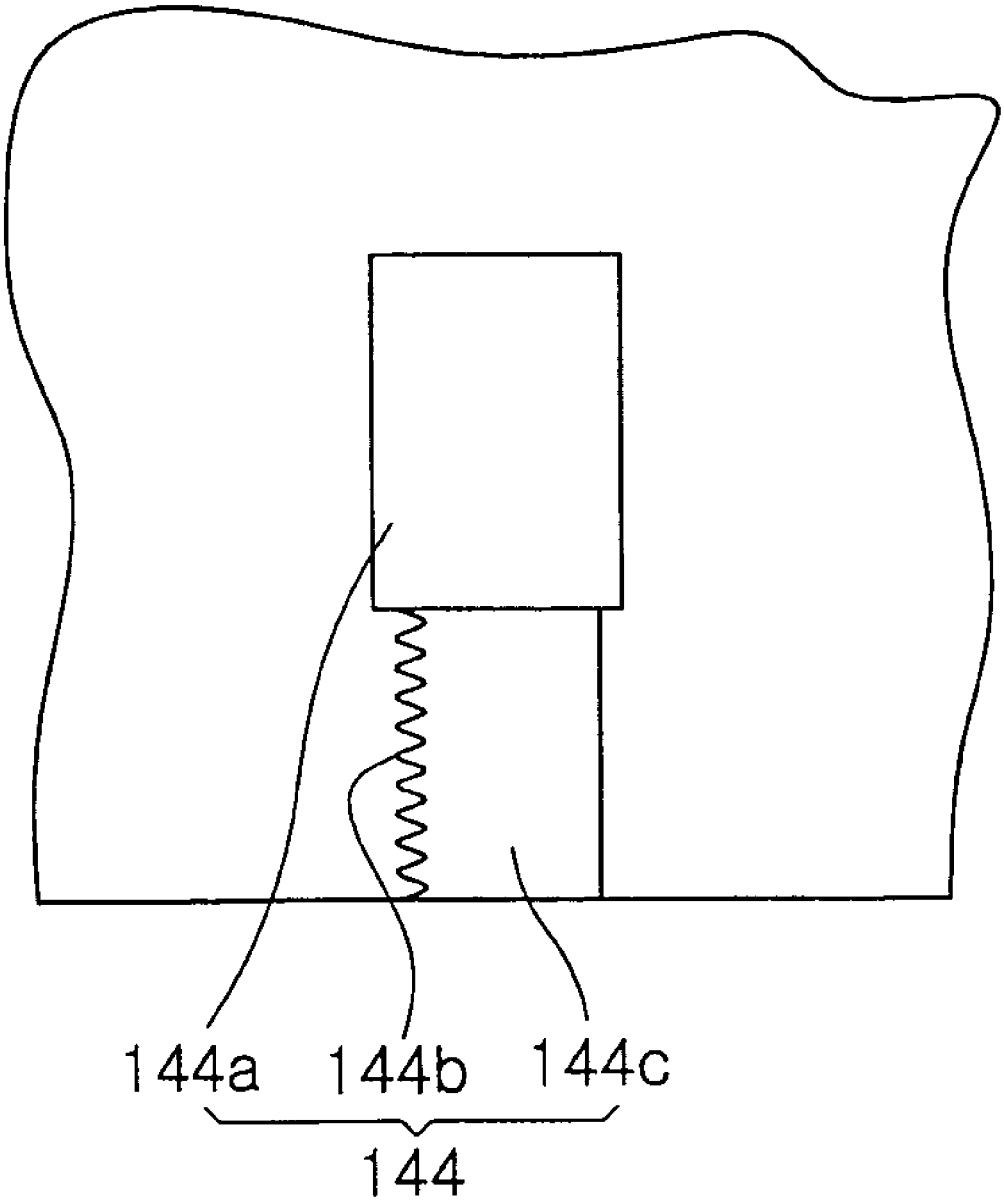
FIG. 4F is a side view of a fastening unit of the grinding mount of the grinding assembly according to the present invention.

Referring next to FIGS. 4E and 4F, at least two fastening units 144 may be provided on a sidewall of the grinding mount 130. Each of the fastening units 144 includes a head portion 144*a*, a second guide 144*b* defining a passage, and a fixing member 144*c* integral with the head portion 144*a* such that the fixing member 144*c* can be moved along the second guide 144*b* when downward pressure is exerted on the head portion 144*a*. The second guide 144*b* and the fixing member 144*c* are provided with snap projections to keep the fixing member 144*c* in place. The grinding plate 110 has third fixing grooves 116 in a sidewall thereof at positions corresponding to the passages defined by the second guides 144*b*. The third fixing grooves 116 receive the fixing members 144*c*, respectively, in a press- or snap-fit manner when the head portions 144*a* are pressed downwardly.

A method of fastening the grinding plate 110 to the grinding mount 130 will be now be described.

First, the fixing pins 112 are inserted into the first fixing grooves 136 of the grinding mount 130, respectively. Next, the grinding plate 110 is rotated relative to the grinding mount 130 to move fixing pins 112 along the first guides 138 until the fixing pins 112 are located in the second fixing grooves 140, respectively. At this time, the grinding plate 110 and the grinding mount 130 are pressed together to force the coupling projections 114 through the rubber packings 135 whereupon the coupling projections 114 are seated on the rubber packings 135 within the bottoms of the second fixing grooves 140. Also, at this time, the flat top and bottom surfaces of the grinding plate 110 and the grinding mount 130 are brought into contact with each other in a horizontal plane.

Thus, the fixing pins 112 are prevented from being removed from the respective second fixing grooves 140, whereby the grinding plate 110 is coupled to the grinding mount 130. Then, a vacuum is formed in the first and second vacuum passages 132 and 134 in the grinding mount 130. Accordingly, the vacuum acts to maintain the fixing pins 112 within the second fixing grooves 140 via the first vacuum passages 132, and acts to maintain the top surface of the plate body of the grinding plate 110 against the bottom surface of the grinding mount 130 via the second vacuum passages 134. Next, the fixing members 144*c* of the respective fixing units 144 are inserted into the third fixing grooves 116 in the sidewall of the grinding plate 110. Accordingly, the fixing members 144*c* fix the grinding plate 110 to the grinding mount 130 and ensure that the rotation of the grinding mount 130 is transferred to the grinding plate 110.

Also, once the coupling projections 114 are received within the bottoms of the second fixing grooves 140, i.e., once the grinding plate 110 is coupled to the grinding mount 130, the grinding plate 110 can be fastened to the grinding mount 130 in just one of those ways described above. For instance, the grinding plate 110 can be fastened to the grinding mount 130 using only a vacuum applied to the fixing pins 112 through the first vacuum passages 132 connected to the second fixing grooves 140. Alternatively, the grinding plate 110 can be fastened to the grinding mount 130 using only a vacuum applied to the grinding plate 110 through the second vacuum passage 134. Alternatively, the grinding plate 110 can be fastened to the grinding mount 130 by the fastening units 144.

According to the present invention, the grinding plate 110 is secured to the grinding mount 130 after the grinding plate 110 is initially coupled to the grinding mount 130 using the fixing pins 112. Thus, the grinding plate 110 can be fastened to the grinding mount 130 quickly.

Finally, although the present invention has been particularly shown and described with reference to the preferred embodiments thereof, various changes in form and details may be made thereto without departing from the true spirit and scope of the present invention as defined by the following claims.

What is claimed is:

1. A grinding assembly for use in the manufacturing of semiconductor devices, said grinding assembly comprising:

a grinding plate having grinding projections at the bottom thereof, and at least two fixing pins protruding at the top thereof, each of the fixing pins having a coupling projection;

a grinding mount having a bottom surface against which the grinding plate rests, at least two first fixing grooves in the bottom surface, at least two second fixing grooves in the bottom surface and in which the fixing pins are received, respectively, and first guide grooves extending in the bottom surface along respective arcs of a circle, each of the first guide grooves connecting a respective one of said first fixing grooves to a respective one of said second fixing grooves; and a rotary shaft connected to said grinding mount opposite the grinding plate, whereby the grinding plate is rotated by the rotary shaft via the grinding mount, wherein each of the fixing pins comprises a pin body, and the coupling projection is a spherical projection at the tops of the pin body.

2. A grinding assembly for use in the manufacturing of semiconductor devices, said grinding assembly comprising:

a grinding plate having grinding projections at the bottom thereof, and at least two fixing pins protruding at the top thereof, each of the fixing pins having a coupling projection;

a grinding mount having a bottom surface against which the grinding plate rests, at least two first fixing grooves in the bottom surface, at least two second fixing grooves in the bottom surface and in which the fixing pins are received, respectively, and first guide grooves extending in the bottom surface along respective arcs of a circle, each of the first guide grooves connecting a respective one of said first fixing grooves to a respective one of said second fixing grooves; and a rotary shaft connected to said grinding mount opposite the grinding plate, whereby the grinding plate is rotated by the rotary shaft via the grinding mount, wherein the second fixing grooves are deeper than the first fixing grooves.

3. A grinding assembly for use in the manufacturing of semiconductor devices, said grinding assembly comprising:

a grinding plate having grinding projections at the bottom thereof, and at least two fixing pins protruding at the top thereof, each of the fixing pins having a coupling projection;

a grinding mount having a bottom surface against which the grinding plate rests, at least two first fixing grooves in the bottom surface, at least two second fixing grooves in the bottom surface and in which the fixing pins are received, respectively, and first guide grooves extending in the bottom surface along respective arcs of a circle, each of the first guide grooves connecting a respective one of said first fixing grooves to a respective one of said second fixing grooves; and a rotary shaft connected to said grinding mount opposite the grinding plate, whereby the grinding plate is rotated by the rotary shaft via the grinding mount, wherein the grinding mount further comprises annular rubber packings fixed on walls of the grinding mount which define the sides of the second fixing grooves, respectively, each of said packings having an inner diameter smaller than the diameter of the second fixing groove and smaller than the diameter of the coupling projection received in the second fixing groove such that the packings hold the fixing pins within the second fixing grooves.

4. A grinding assembly for use in the manufacturing of semiconductor devices, said grinding assembly comprising:

a grinding plate having grinding projections at the bottom thereof, and at least two fixing pins protruding at the top thereof, each of the fixing pins having a coupling projection;

a grinding mount having a bottom surface against which the grinding plate rests, at least two first fixing grooves in the bottom surface, at least two second fixing grooves in the bottom surface and in which the fixing pins are received, respectively, and first guide grooves extending in the bottom surface along respective arcs of a circle, each of the first guide grooves connecting a respective one of said first fixing grooves to a respective one of said second fixing grooves; and a rotary shaft connected to said grinding mount opposite the grinding plate, whereby the grinding plate is rotated by the rotary shaft via the grinding mount, wherein the grinding mount further comprises fixing balls protruding into the first guide grooves, respectively, at ends of the first guide grooves adjacent the second fixing grooves.

5. A grinding assembly for use in the manufacturing of semiconductor devices, said grinding assembly comprising:

a grinding plate having grinding projections at the bottom thereof, and at least two fixing pins protruding at the top thereof, each of the fixing pins having a coupling projection;

a grinding mount having a bottom surface against which the grinding plate rests, at least two first fixing grooves in the bottom surface, at least two second fixing grooves in the bottom surface and in which the fixing pins are received, respectively, and first guide grooves extending in the bottom surface along respective arcs of a circle, each of the first guide grooves connecting a respective one of said first fixing grooves to a respective one of said second fixing grooves; and a rotary shaft connected to said grinding mount opposite the grinding plate, whereby the grinding plate is rotated by the rotary shaft via the grinding mount, wherein the grinding mount has a sidewall, and further comprising at least two fastening units mounted on the sidewall of the grinding mount, each of the fastening units detachably securing the grinding plate to the grinding mount.

6. A grinding assembly for use in the manufacturing of semiconductor devices, said grinding assembly comprising:

a grinding plate having grinding projections at the bottom thereof, and at least two fixing pins protruding at the top thereof, each of the fixing pins having a coupling projection;

a grinding mount having a bottom surface against which the grinding plate rests, a plurality of fixing grooves in the bottom surface and in which the fixing pins are received, respectively, holding means for holding the coupling projections of the fixing pins within the fixing grooves, whereby the grinding plate is coupled to the grinding mount;

fastening means for detachably securing the grinding plate to the grinding mount; and a rotary shaft connected to said grinding mount opposite the grinding plate, whereby the grinding plate is rotated by the rotary shaft via the grinding mount.

7. The grinding assembly of claim 6, wherein said grinding mount has a first vacuum passage connected to said fixing grooves.

8. The grinding assembly of claim 6, wherein said grinding mount has a plurality of second vacuum passages spaced along a circle and open at the bottom surface thereof.

9. The grinding assembly of claim 7, wherein said fastening means comprises a vacuum pump connected to the first vacuum passage.

10. The grinding assembly of claim 7, wherein said fastening means comprises a vacuum pump connected to the second vacuum passages.

11. The grinding assembly of claim 7, wherein said holding means comprises annular rubber packings fixed on walls of the grinding mount which define the sides of the second fixing grooves, respectively, each of said packings having an inner diameter smaller than the diameter of the second fixing groove and smaller than the diameter of the coupling projection received in the second fixing groove such that the packings hold the fixing pins within the second fixing grooves.

12. The grinding assembly of claim 7, wherein the grinding mount further comprises fixing balls protruding into the first guide grooves, respectively, at ends of the first guide grooves adjacent the second fixing grooves.

13. The grinding assembly of claim 7, wherein said fastening means comprises at least two fastening units mounted on the sidewall of the grinding mount, each of the fastening units detachably securing the grinding plate to the grinding mount.

14. A method of fastening a grinding plate to a grinding mount, the grinding plate having grinding projections at the bottom thereof and at least two fixing pins protruding at the top thereof, and the grinding mount having a bottom surface and a plurality of fixing grooves in the bottom surface, said method comprising:

initially coupling the grinding plate to the grinding mount, comprising inserting the fixing pins into the fixing grooves to bring a top surface of the grinding plate flush against the bottom surface of the grinding mount, and holding the fixing pins within the fixing grooves; and after the fixing pins are held in the fixing grooves, detachably securing the grinding plate to the grinding mount using a fastening system.

15. The method of claim 14, wherein said securing of the grinding plate to the grinding mount comprises forming a vacuum in the fixing grooves to thereby exert vacuum pressure on the fixing pins.

16. The method of claim 14, wherein said securing of the grinding plate to the grinding mount comprises forming a vacuum at an interface between the bottom surface of the grinding mount and the top surface of the grinding plate.

17. The method of claim 14, wherein said securing of the grinding plate to the grinding mount comprises mechanically fastening the grinding plate to the grinding mount.

18. The method of claim 14, wherein said coupling of the grinding plate to the grinding mount comprises forcing the fixing pins to the bottom of the fixing grooves, respectively, through rubber packings each having an inner diameter smaller than that of the outer diameter of coupling projections of the fixing pins, whereby the rubber packings hold the fixing pins in the fixing grooves.

* * * * *